US005138776A

United States Patent [19]

Levin

[11] Patent Number: 5,138,776

[45] Date of Patent: Aug. 18, 1992

[54] SPORTS SHOE

[76] Inventor: Shalom Levin, 8/9 Simtat Rodan, Haifa 35590, Israel

[21] Appl. No.: 634,081

[22] Filed: Dec. 26, 1990

Related U.S. Application Data

[63] Continuation-in-part of Ser. No. 409,236, Sep. 3, 1989.

[30] Foreign Application Priority Data

Dec. 12, 1988 [IL] Israel ..... 088761

[51] Int. Cl.[5] ..... A43B 21/30

[52] U.S. Cl. ..... 36/38; 36/27; 36/35 R

[58] Field of Search ..... 36/7.8, 27, 28, 35 R, 36/37, 38

[56] References Cited

U.S. PATENT DOCUMENTS

| | | | |
|---|---|---|---|
| 805,088 | 12/1904 | McLaughlin | 36/38 |
| 933,848 | 9/1909 | Pease | 36/27 |
| 1,088,328 | 2/1914 | Cucinotta | 36/28 |
| 1,114,685 | 10/1914 | Freeman | 36/37 |
| 1,240,153 | 9/1917 | Olsen | 36/37 |
| 1,297,922 | 3/1919 | Skinner et al. | |
| 1,471,966 | 10/1923 | Light | 36/38 |
| 1,920,112 | 7/1933 | Shaft | 36/37 |
| 2,383,877 | 8/1945 | Miller | |
| 2,447,603 | 8/1948 | Snyder | 36/38 |
| 2,508,318 | 5/1950 | Wallach | 36/38 |
| 2,814,132 | 11/1957 | Montoscuro | 36/37 |
| 3,142,910 | 8/1964 | Levine | 36/37 X |
| 3,214,849 | 11/1965 | Nadaud | |
| 3,822,490 | 7/1974 | Murawski | 36/35 R X |
| 4,492,046 | 1/1985 | Kosova | 36/38 X |
| 4,566,206 | 1/1986 | Weber | 36/38 X |
| 4,592,153 | 6/1986 | Jacinto | 36/38 |
| 4,638,575 | 1/1987 | Illustrato | 36/28 X |
| 4,843,737 | 7/1989 | Vorderer | |
| 4,881,329 | 11/1989 | Crowley | |

FOREIGN PATENT DOCUMENTS

| | | | |
|---|---|---|---|
| 0016130 | 11/1881 | Fed. Rep. of Germany | 36/38 |
| 0141998 | 6/1903 | Fed. Rep. of Germany | 36/28 |
| 0065498 | 2/1914 | Fed. Rep. of Germany | 36/27 |
| 318679 | 2/1903 | France | |
| 0905244 | 11/1945 | France | 36/28 |
| 088761 | 12/1990 | Israel | |
| 281482 | 1/1931 | Italy | |
| 0633409 | 2/1962 | Italy | 36/38 |
| 0425537 | 5/1967 | Switzerland | 36/28 |
| 1300 | of 1900 | United Kingdom | |
| 0591740 | 8/1947 | United Kingdom | 36/38 |
| 2111823 | 7/1983 | United Kingdom | 36/38 |

*Primary Examiner*—Paul T. Sewell
*Assistant Examiner*—Ted Kavanaugh
*Attorney, Agent, or Firm*—Frishauf, Holtz, Goodman & Woodward

[57] ABSTRACT

The sports shoe according to the invention has a highly elastic heel which reduces the shock on the foot during running and jogging. The heel which is made of a resilient, elastic material is in the shape of a strip which is arched in dowward direction and connected to the sole at its front end while forming a longitudinal cavity with the sole which is open towards the rear end of the shoe. A spring composed of two leaves which are connected at one end and unconnected at the other end of the spring, are inserted into the cavity with the connected ends positioned at the front end of the cavity and with the unconnected ends close to the rear end of the heel, whereby the upper of the two leaves is connected to the sole and the lower, strongly bent leaf to the arched heal strip. The rear end of the lower leaf is free to slide or to roll along the rear portion of the upper leaf in accordance with the pressure applied to the heel surface during jogging or running, thereby largely increasing the range of compression and decompression of the heel strip resulting in more comfort of the wearer.

10 Claims, 3 Drawing Sheets

SPORTS SHOE

This application is a continuation-in-part of application Ser. No. 07/409,236, filed Sep. 19, 1989, now abandoned.

BACKGROUND OF THE INVENTION

The invention relates to a sports shoes, more especially to sports shoes with resilient, highly elastic heels.

During most kinds of modern competitive sports, such as basketball, volleyball, tennis and other games requiring the participants to run and to jump, the impact between foot and floor is hard, and particularly hard on the heel. This impact ofter leads to injuries to the human body, mostly parts of the feet and legs, and many joggers and runners suffer from knee injuries due to the sudden shock transferred from the heel to the relatively soft cartilage of the knee. To sum up, there happen to occur innumerable injuries to the ankle, the knee and to the vertebrae of the spinal column, owing to non-elastic shoes worn by the sportsman.

In order to prevent these kinds of injuries, as far as possible, there exist many types of sports shoes provided with elastic heels. Since it became evident that a solid heel made from an elastomer does not give the desired relief by spring action, most modern sports shoes now have heels provided with air-filled cavities. The air in the cavity or cavities is purported to be compressed by impact of the heel with the floor and to be expanded immediately upon lifting of the shoe, in order to be prepared for the next impact. There exist heels with open or with closed air-filled cavities, but it has been found that their efficiency is minimal for the following reasons: increase of air pressure in the cavity is effected by a very small heel deflection and results in a relatively small working travel; even taking into account the compression of the cartilage the impact shock is, nevertheless, not sufficiently damped to prevent an injury or a permanent incapacity to the sportsman or sportswoman.

In order to increase the elasticity of the heel material some sport shoes include metal springs inserted into suitable heel cavities, and some modern embodiments of this kind are disclosed in U.S. Pat. No. 4,638,575 (Illustrato), U.S. Pat. No. 4,843,737 (Vorderer), and U.S. Pat. No. 4,881,329 (Crowley). However, since in these embodiments the shoe is flat, i.e. the heel and the sole lie in the same flat surface, the springs do not add much to the elasticity of the heel, the more as the parts in front and to the rear ofthe cavity are made of soild material, such as rubber, and do contribute very little to the total deflection.

The present invention has the object to provide a sports shoe with a heel of great elasticity, owing to a long deflection and, accordingly, high gradual compression rate.

It is another object to provide a sports shoe with a heel which will return to its original shape immediately upon removal of the load, as soon as the foot is lifted off the ground, with the aim of reducing the shock to the body and to return to the runner more energy than obtainable with conventional shoes.

It is another object to provide a heel with spring means for ready inclusion in a cavity, in order to increase its elasticity.

It is an alternative object to provide springs of various load and compression factors for alternative insertion into a cavity of the heel for use of the same shoe for different kinds of sports or adaptation of the same shoe size to persons of different weight.

And it is a final object to produce this kind of sports shoe at low cost with a view to keeping their price at a level with the known, conventional brands.

SUMMARY OF THE INVENTION

A sports shoe according to the present invention comprises an upper, a sole and a heel and is characterized by that the heel is in the form of a relatively thick strip of a resilient and flexible material connected to the sole at least at its front end and separated from the rest of the sole by a lengthwise extending cavity. Its tread surface is arched in downward direction and is supported by the lower leaf of a two-leaf spring hugging the lower wall of the cavity. The spring is composed of at least two thin, bent metal leaves of a resilient material abutting at their outer ends and extending substantially parallel to the axis of the shoe. The heel and the sole are built to permit rearward extension of the spring and the strip whenever the heel is compressed by a load into flat or nearly flat shape, and to effect its return into arched shape as soon as the load is removed.

In one embodiment the heel strip is connected both at its front and its rear end to the sole, while the spring is composed of two outwardly bent leaves in the form of a so-called elliptical spring. The surfaces of the sole and the strip correspond to the outer contours of the spring and enclose it with small clearances. With a view to obtaining maximum compression of the spring, a cavity may be provided adjacent the sole and above the front portion of the heel strip, while a V-shaped recess is provided above the rear end of the heel and the spring, permitting these parts to extend rearwardly and thus to compress the spring up to final contact of the two leaves.

As an alternative the heel strip is connected at its front end to the sole, while its rear end is free to slide along the rear end of the sole, while the spring is composed of two leaves bent in the same sense of direction, whereby the upper leaf is less flexible and is bent to a larger radius than the lower leaf, enabling the rear end of the lower leaf to slide along a portion of the upper leaf. In this embodiment it is preferable to cover the leaves along the sides facing each other with a thin layer of the sole and strip material, with a view to prevent corrosion of the metal and to effect damping of the contact shock between the springs at full compression. In order to reduce friction to a minimum, the contacting surfaces may be coated with an anti-friction material or be provided with anti-friction inserts such as teflon-bronze or the like. By changing the position of the inserts in forward or rearward direction, the strength and deflection of the spring can be changed to a certain extent.

An improvement of the latter embodiment comprises a roller fastened to the rear end of the lower leaf spring, whereby the sliding motion is replaced by rolling motion, reducing the friction between the springs and thereby greatly enhancing the mobility of the heel strip and the sole as well as the comfort of the wearer.

The fixed roller may be replaced by a an unattached roller loosely placed between the upper and the lower spring near the open rear end, transversely to the shoe axis, again converting sliding to rolling motion. It is evident that by reducing friction, more energy is saved and is stored in the spring, which will be returned to the runner while the heel expands.

The unattached roller is advantageously guided in a cavity provided in the upper spring leaf, so as to be held in position as well as to limit its travel.

And still another improvement consists in forming the opposed surfaces of the upper and the lower spring as gear racks and placing a ribbed roller therebetween, again converting sliding into rolling motion. This arrangement enables changing the position of the roller in either forward and rearward direction, in accordance with the weight of the person wearing the shoe, adding to his or her comfort while running.

In still another alternative embodiment each leaf may be composed of several thin strips of an elastic material similar to the leaf spring in motorized vehicles, socalled laminated springs, and the two leaves may be pivotally connected at their both ends, to form an elliptical spring.

While in any of the conventional sports shoes provided with a flat or chamfered heel contact with the ground changes and moves from the rear end to the front of the heel during the "landing" stage of the runner, compression energy in the heel is lost and then not returned to the runner. Contrariwise, with the present arched heel the ground is contacted at the lowest point in the central part of the heel and the entire energy produced at the "landing" stage is stored in the spring which during expansion returns this energy to the runner while he lifts his leg.

SHORT DESCRIPTION OF THE DRAWINGS

FIG. 1 is a longitudinal section of a heel of a sports shoe, showing an elliptical spring inserted in a co-extensive cavity formed by the heel strip and the sole, FIG. 2 is a section through the heel shown in FIG. 1 along line A—A, for a heel provided with an exchangeable spring, FIG. 3 shows one of the spring leaves forming the elliptical spring illustrated in FIG. 1, FIG. 4 is a longitudinal section of a heel showing a heel strip connected to the sole at its front end only and a spring composed of two downwardly bent leaves connected at their front ends.

FIG. 5 is a section of a heel similar to that illustrated in FIG. 1, provided with a twin laminated spring, FIG. 6 shows an improvement to the heel illustrated in FIG. 4 by the attachment of a roller to the unconnected end of the heel strip and of the lower spring, FIG. 7 shows an alternative to the heel shown in FIG. 6, comprising a roller loosely placed between the ends of the two springs, and FIG. 8 illustrates a heel wherein the roller of FIG. 7 is replaced by a ribbed roller moving between two racks formed on the respective surfaces of the heel strip and the sole.

DETAILED DESCRIPTION OF THE DRAWINGS

Figure 1:
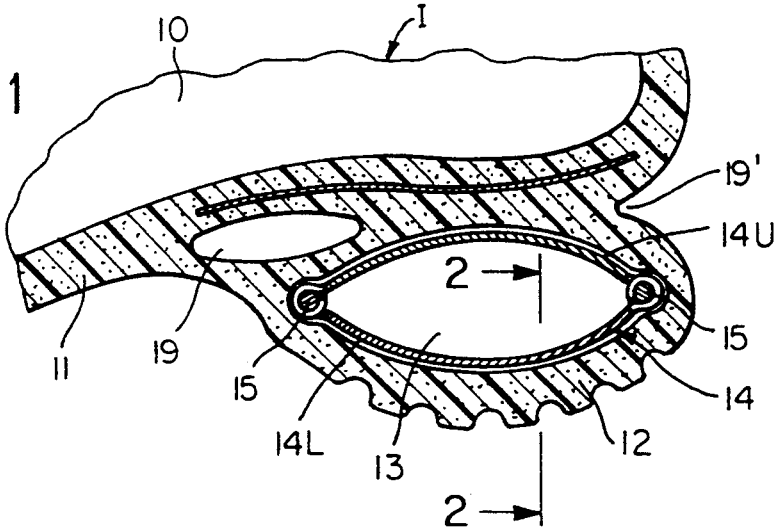
Figure 2:
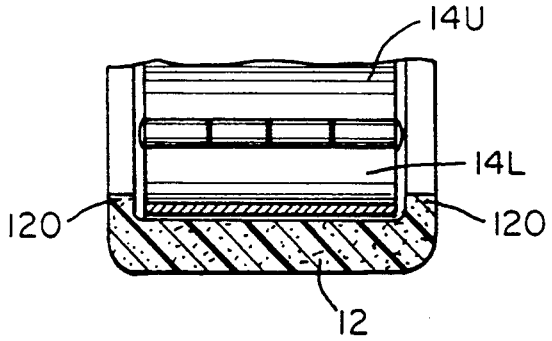
Figure 3:
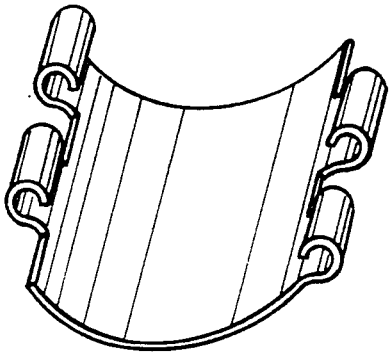

Referring to FIGS. 1, 2 and 3 of the drawings a sports shoe 1 consists of an upper 10, a sole 11 and a heel strip 12, the sole and the heel being generally made of a polymer such as rubber or plastics or a combination thereof, while the upper is usually made of a woven material or of leather. The heel strip 12 is connected at its both ends to the sole 11 the two forming an oblong cavity 13 of pseudo-elliptical cross section, which is through-going, i.e. is open on both sides of the heel, as shown in FIG. 2. An elliptical spring 14 is positioned in the cavity 13; it is composed of two leaves 14U and 14L, one of which is shown in FIG. 3, which are pivotally connected at their ends by means of two pins 15. The spring can be inserted into the cavity from one of the open sides shown in FIG. 2, or it can be inserted into the casting die before injection of the material. As can be seen from FIG. 2, shoulders 120 hold the spring in position and prevent its being pressed out of the cavity while being compressed during running; in addition the bottom shoulders contact the top shoulders before complete collapse of the spring, thus damping the shock. In order to increase the flexibility of the heel a smaller cavity 19 is provided at the front end of the heel just above the front end of the spring, which may be filled with air or with a sponge-like material. In addition a V-shaped recess 19' is positioned between heel and sole permitting ready compression of the heel material and the spring to be compressed in an upward direction.

It is pointed out that the heel in this embodiment of a shoe is not flat as in conventional sports shoes but is downwardly rounded or arched in conformity with the shape of the inserted spring, which permits a large deflection and long compression path and, accordingly, a uniform compression rate, important for comfortable running or jumping. It also serves to store energy while being compressed which is being released and transferred to the runner during expansion of the spring.

Figure 4:
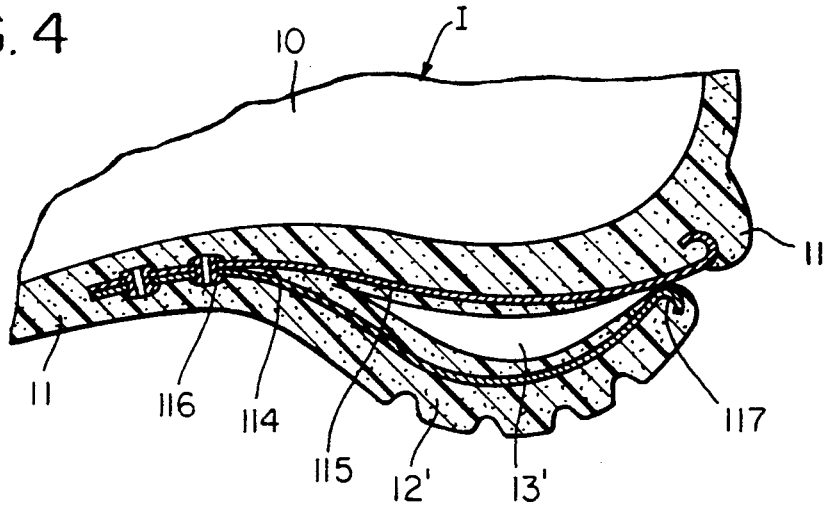

The sports shoe of FIG. 4 includes a similarly shaped heel strip 12' which is, however, not connected to the sole at its rear end, so as to permit a certain relative movement between heel and sole, which allows for increased deformation of the heel by the impact on the ground. The spring inserted into the heel of this shoe is composed of an upper, relatively stiff leaf 115 and a lower, relatively flexible leaf 114, both bent in identical downward direction, but at different curvatures, wherein the upper leaf is bent at a much larger radius than the lower one. The two leaves are connected at their front end

116, while the rounded rear end 117 of the lower leaf 114 is free to slide along a portion of the upper leaf 115. Both leaves are covered by a thin layer of the heel and sole material, in order to protect their surface against corrosion and to damp the shock of the leaves at mutual contact. As mentioned before the contact areas between the two spring leaves may be coated with an anti-friction material or be provided with anti-friction inserts.

Upon load being applied to the underside of the heel, the lower leaf 114 and the heel strip 12' are straightened by the force from below, and the rear end of the spring leaf 114 slides along the upper leaf 115, the latter, as well as the sole 11 being bent by the force to a small extent only. It is selfunderstood that the material of the heel strip is sufficiently soft and resilient to follow the movement of the spring leaves and to return at the same rate.

The advantage of this embodiment lies in simultaneous bi-directional movement of the heel, combining vertical deflection of the heel and relative longitudinal movement of the sole, which helps to propel the runner in the forward direction.

Figure 6:
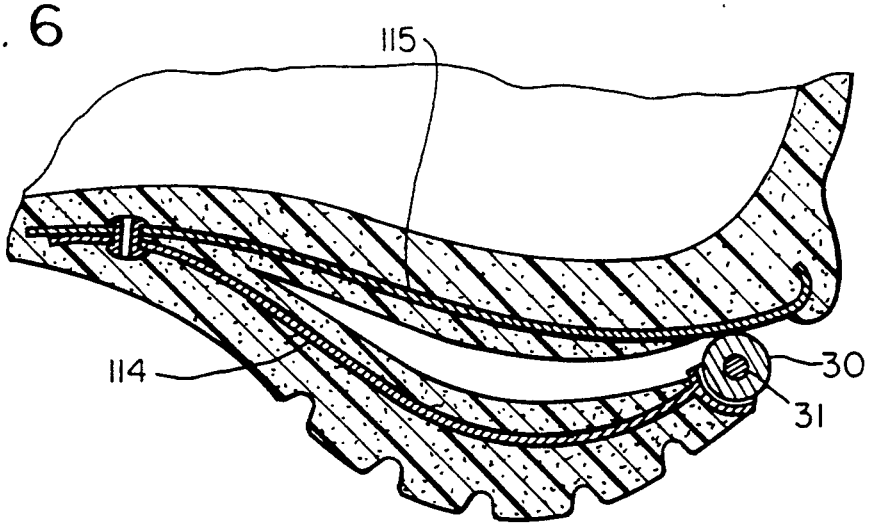
Figure 7:
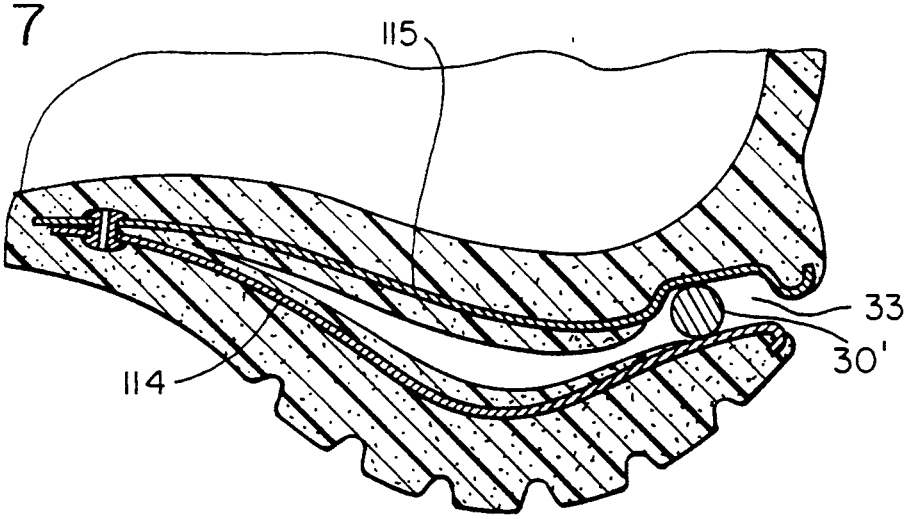
Figure 8:
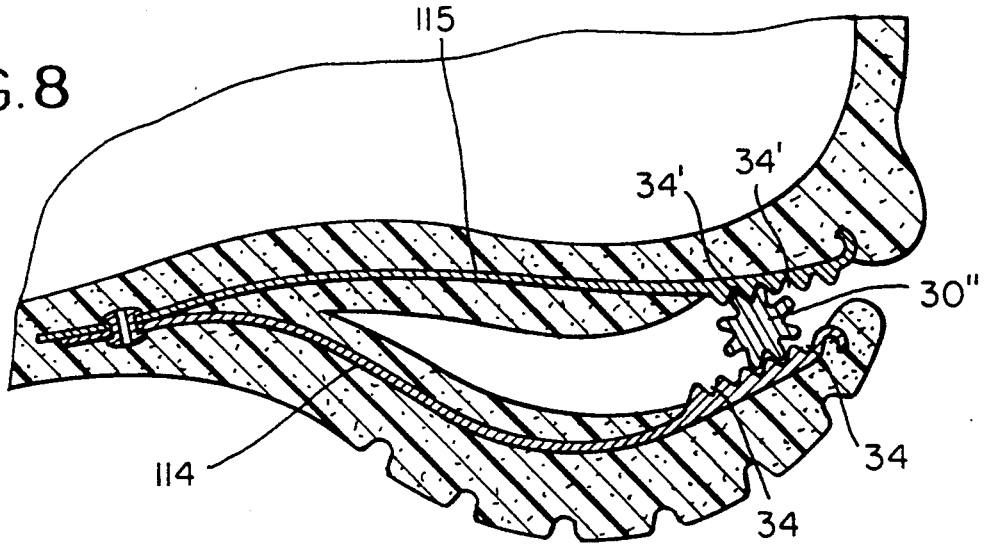

FIGS. 6, 7 and 8 illustrate improvements to the heel shown in FIG. 4 which is not connected to the sole at its rear end to ensure greater deformation by impact with the ground. Whereas the heel of FIG. 4 slides along the sole, the embodiments shown in FIGS. 6, 7 and 8 have the object to reduce the friction and loss of energy caused by the sliding motion of the lower spring along the upper spring by placing a rolling element between the two springs.

The embodiment of the heel illustrated in FIG. 6 is substantially identical with that shown in FIG. 4, with the addition of a roller 30 rotatably mounted on a horizontal pin 31 which is transversely fastened to the end of the lower spring 114. The roller 30 is in permanent contact with the upper spring 115, and upward pressure on the heel moves it to the rear in rolling motion along the surface of the upper spring 115. The roller may be mounted on a plain shaft or on small needle bearings to reduce friction and thus to store energy.

FIG. 7 illustrates a similar arrangement: however, in this case, the roller 30' is not fixedly attached to the end of the lower spring 114, but is loosely inserted between the two springs 114 and 115. In order to prevent the roller from accidental slipping out, the upper spring 115 is bent to form an inwardly extending recess 33 of a depth less than the roller's diameter. Rearward motion of the heel effects rearward rolling of the roller 30' along the base of the recess 33.

The embodiment illustrated in FIG. 8 acts on the same principle as that of FIG. 7. Herein the smooth roller is replaced by a ribbed roller 30'' resembling a gear wheel which is held in position by a number of consecutive transverse slots 34 and 34' in the lower and upper spring surfaces respectively. These slots resemble a rack along which the gear wheel can move, while the heel is depressed by contact with the ground. With a view to adapting the heel to the weight of the wearer the ribbed roller can be placed more forwardly or more rearwardly, thus changing the bending moment.

Figure 5:
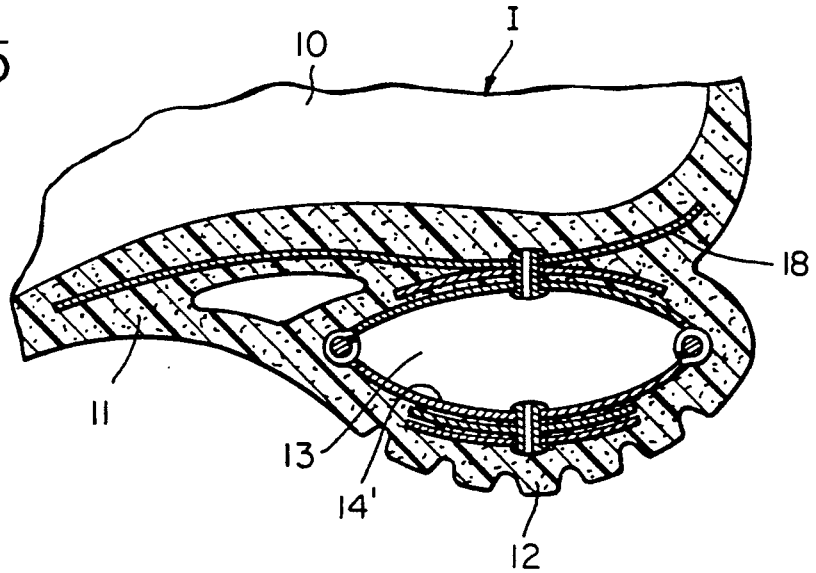

The heel and the spring illustrated in FIG. 5 are similar to those shown in FIG. 1, with the difference that the spring 14' is laminated similar to springs used in car suspensions. The spring consists of a lower portion composed of three leaves and an upper portion composed of two leaves which are connected to another leaf spring 18 embedded in the sole. Connection is made by known connection means such as the hollow rivet depicted in the drawing. The springs 14' and 18 are inserted into the heel and the sole during manufacture, as e.g. by injection moulding, and are not interchangeable as in the case of the shoe shown in FIG. 1. Another advantage of the laminated spring is its being uniformly stressed over its entire length.

It will be understood that the aforedescribed heels and springs represent only a few examples of the many embodiments of the invention which may be conceived and designed by a person skilled in the art, within the spirit of the invention and the scope of the appended claims.

I claim:

1. A sports shoe comprising a front portion and a rear portion, an upper, a sole and a highly elastic heel, said heel including a relatively thick heel strip of a flexible and resilient material having a tread surface and an upper surface, with a front end of the upper surface being attached to said sole while the remainder of said upper surface is separated from said sole at said rear portion by a lengthwise extending cavity, said heel strip being curved in a concave manner in an unloaded state and supported by a leaf spring bent coextensively with the upper surface of said heel, said heel strip together with said spring being adapted to be flattened and stretched in a rearward direction by a load exerted by the weight of a person wearing said shoe, while running or jumping, and to be returned into its curved shape immediately upon release of the load.

2. The sports shoe as defined in claim 1, wheren said spring comprises an upper and a lower leaf co-extensive with said cavity, the upper leaf being adjacent said sole and the lower leaf adjacent the upper surface of said heel strip.

3. The sports shoe as defined in claim 2, wherein the front ends of said upper and said lower leaf are interconnected, while the rear end of said lower leaf, together with a rear end of said heel strip, is adapted to slide along the upper leaf, under a load exerted on the tread surface of said heel.

4. The sports shoe as defined in claim 3, wherein the rear end of said lower leaf is provided with a roller adapted to roll along said upper leaf under load.

5. The sports shoe as defined in claim 3, wherein a roller is loosely positioned between the rear ends of the upper and the lower leaf of said spring effecting rolling contact of the lower leaf on the upper leaf.

6. The sports shoe as defined in claim 3, wherein a ribbed roller is positioned between the upper and the lower leaf, the rear ends of both leaves being provided with parallel slots forming racks for movement therein of said ribbed roller.

7. The sports shoe as defined in claim 3, wherein said leaves of said spring are embedded in the material of said sole and/or said heel strip, in order to effect protection against corrosion as well as to dampen the shock caused by contact of said spring leaves.

8. The sports shoe as defined in claim 3, wherein contact areas of the upper and the lower leaf are coated with an anti-friction material.

9. The sports shoe as defined in claim 3, wherein contact areas of the upper and the lower leaf are provided with inserts of an anti-friction material.

10. The sports shoe as defined in claim 2, wherein said leaves of said spring are embedded in the material of said sole and/or said heel strip, in order to effect protection against corrosion as well as to dampen the shock caused by contact of said spring leaves.

* * * * *